United States Patent [19]

Mendelsohn

[11] 4,317,061

[45] Feb. 23, 1982

[54] PRESSURE COMPENSATING DEVICE FOR A PLASMA DISPLAY PANEL

[75] Inventor: Charles Mendelsohn, Monsey, N.Y.

[73] Assignee: United Technologies Corporation, Hartford, Conn.

[21] Appl. No.: 104,606

[22] Filed: Dec. 17, 1979

[51] Int. Cl.[3] ..... H01J 17/22; H01J 17/49

[52] U.S. Cl. ..... 313/174; 313/148; 313/220

[58] Field of Search ..... 313/174, 148, 220; 315/108, 110

[56] References Cited

U.S. PATENT DOCUMENTS

| | | | |
|---|---|---|---|
| 1,656,213 | 1/1928 | Mallory | 313/148 X |
| 2,054,048 | 9/1936 | Braselton | 315/108 X |
| 2,408,661 | 10/1946 | Lee | 315/108 X |
| 2,522,969 | 9/1950 | Smith | 315/110 X |
| 2,523,287 | 9/1950 | Friedman | 315/108 X |
| 2,680,779 | 6/1954 | Anderson | 313/148 X |
| 2,839,701 | 6/1958 | Bourns | 313/148 X |
| 3,517,248 | 6/1970 | Eckel | 313/148 X |
| 3,872,339 | 3/1975 | Maloney | 313/174 X |
| 4,188,558 | 2/1980 | Yamamura | 313/148 X |

*Primary Examiner*—Palmer C. Demeo

*Attorney, Agent, or Firm*—Richard P. Lange

[57] ABSTRACT

A pressure compensating device for a plasma display panel expands from an unextended position at lower altitudes to an expanded position at high altitudes to maintain the pressure differential across the panel sidewalls within predetermined limits. One embodiment includes a bellows assembly positioned on the rear wall of the plasma panel. The end wall of the bellows contacts an internal stop at lower altitudes so that the volume inside the bellows is as small as possible. As the pressure differential across the panel sidewall increases, either as a result of changes in the ambient temperature or pressure, the bellows moves in an axial direction to its extended position providing an additional volume in which the panel gas is received. Accordingly, the pressure differential across the panel sidewall can be maintained below a certain predetermined level irregardless of changes in ambient pressures and temperatures.

9 Claims, 3 Drawing Figures

PRESSURE COMPENSATING DEVICE FOR A PLASMA DISPLAY PANEL

DESCRIPTION

1. Technical Field

This invention relates to a pressure compensating device for use with a plasma panel and, more particularly to a pressure compensating device for maintaining the internal pressure within the sealed interior of a plasma panel within predetermined limits so that the panel can be operated over a wider range of pressures and temperatures.

2. Background Art

Plasma panels are generally known and are one type of display device which comprises large glass plates, normally cut to a rectangular shape, to form front and rear sidewalls through which the display is viewed. The normally transparent sidewalls are also substrates for a plurality of electrodes which are normally positioned on the inside of each substrate forming an orthogonal matrix of laterally spaced electrodes. The two substrates are normally sealed around the edges and spaced apart a sufficient amount to form a chamber or closed envelope. The chamber is evacuated and filled with an ionizationable gas during the manufacturing process. The electrodes on one substrate of the panel form parallel rows of electrodes while the electrodes on the other substrate form column electrodes, the composite of which creates a coordinate grid pattern. Any particular site on the panel can be struck, or lit, by electrically addressing the particular row and column electrode corresponding to that site.

A problem with plasma panels, particularly those in which the substrates are large rectangular plates, is that the panels can fail if operated in environments that are subject to wide extremes in temperature and pressure. This is because during the manufacturing process, the ionizationable gas in the sealed envelope is typically at a pressure of approximately $\frac{2}{3}$ of an atmosphere. If the panel is then used at high altitudes, such as in the cockpit of an aircraft or the like, the ambient pressure outside the panel can drop significantly below the internal pressure. Accordingly, the higher internal pressure can cause a bowing or bending of the plates, particularly near the central portion of the substrates, which tends to increase the spacing between the electrodes on the interior sidewalls. The increased spacing between the two substrates can result in the sites near the central portion of the panel not striking or lighting. Of course, if the outside pressure continues to drop, the pressure differential across the panel sidewall would continue to increase and the circle of unlit sites at the center of the panel would become increasingly larger. Finally, as the aircraft goes higher and higher, the pressure differential across the panel sidewalls can exceed the design limitations of the panel resulting in a rupture of the edge seal, and the panel would fail completely.

DISCLOSURE OF THE INVENTION

It is an object of the present invention to provide a pressure compensating device for use with a plasma panel so that the panel can properly operate over a wider range of pressure and temperature.

According to a feature of the present invention a pressure compensating device for a plasma panel maintains a relatively uniform pressure differential across the panel sidewall of a plasma panel which is essentially independent of heat and altitude.

According to another feature of the present invention a pressure compensating device for a plasma panel eliminates the loss of light output from the center area of the panels normally resulting from operation at high altitudes.

According to still another feature of the pressure compensating device of the present invention is that it reduces the mechanical stress exerted on the sidewall, or substrates, of a plasma panel at high altitudes or high temperature thereby preventing panel failure due to a positive over pressure condition.

According to yet another feature of the present invention a pressure compensating device, such as a small bellows assembly, is positioned on the back of a plasma display panel to maintain the pressure differential across the panel sidewalls within predetermined limits. The bellows assembly has a sealed interior which communicates with the sealed chamber in the plasma panel. The accordion type sidewalls of the bellows allows axial movement, from the rest position against an internal stop, as the panel is operated at a higher and higher altitude. This increasing volume within the bellows maintains the pressure differential across the panel sidewall within a predetermined limit.

BEST MODE FOR CARRYING OUT THE INVENTION

Figure 1:
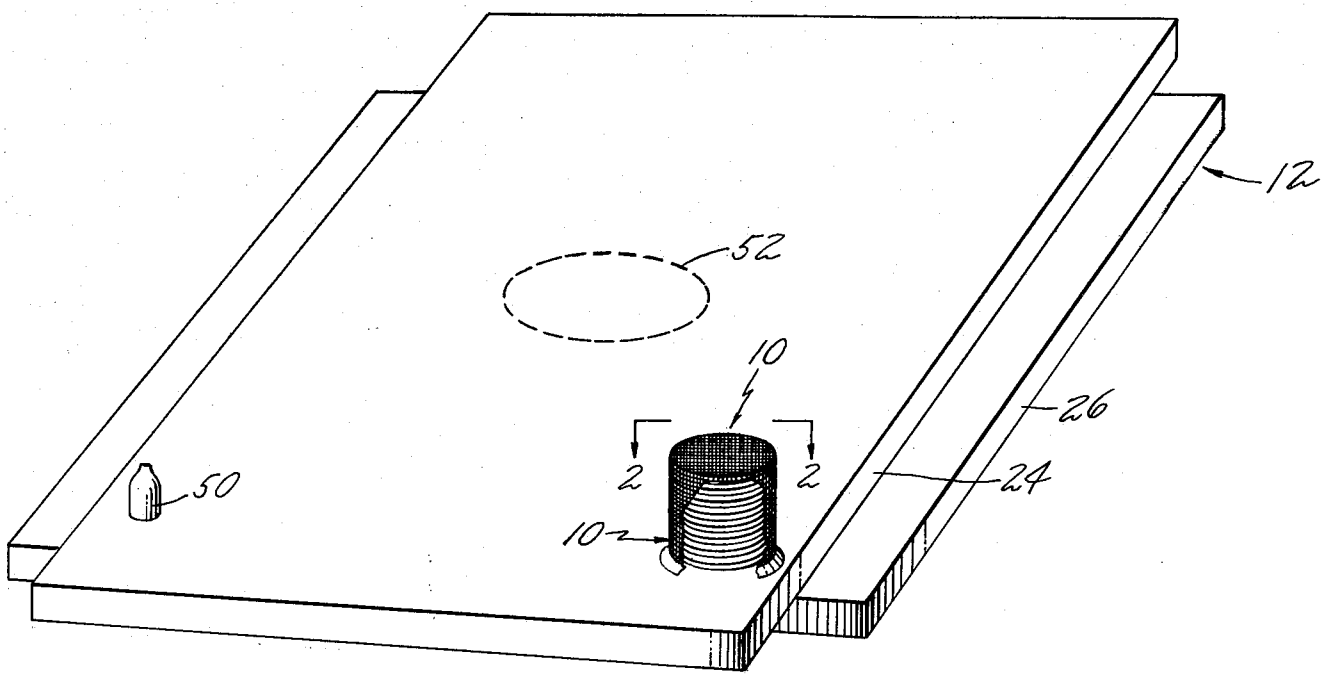
FIG. 1 is a perspective view of a plasma panel showing a pressure compensating device according to the present invention, with a cutaway portion, mounted on the back panel near one corner.

Referring initially to FIG. 1, a pressure compensating device 10 is seen positioned at one corner of a typical plasma panel 12. The pressure compensating device maintains the pressure differential across the panel sidewalls within predetermined limits so that the panel can be operated over a wider range of pressures and temperatures.

Figure 2:
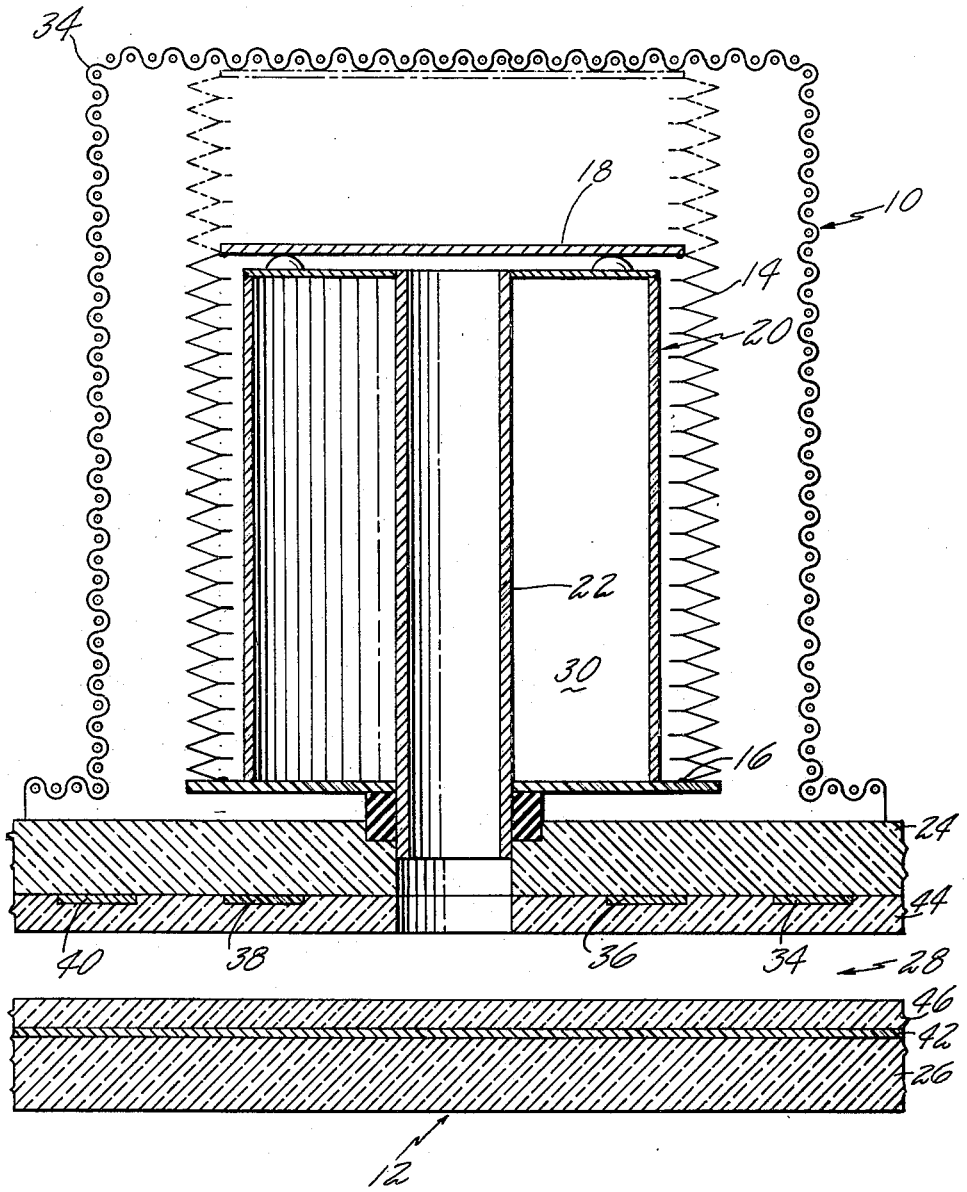
FIG. 2 is an axial section of one embodiment of a pressure compensating device according to the present invention.

Referring additionally to FIG. 2, there is seen, in axial section, one embodiment of a pressure compensating device according to the present invention. This embodiment includes a bellows assembly which has a cylindrical sidewall 14 formed in an accordion-like configuration so that it can move axially. An end wall 16 is sealed against the perimeter of the sidewall 14 to close one end of the bellows while an end wall 18 is sealed against the sidewall perimeter at the other end of the bellows to close that end. A stop 20 is positioned in the interior of the bellows 18 to minimize the volume confined by the bellows in the first or unextended position. The stop 20 also prevents the collapsing of the bellows during the vacuum bake-out in the manufacturing process. Thus, the stop 20 would ideally be cylindrically shaped with closed ends and the interior would be a sealed vacuum chamber. The diameter of the stop 20 would be slightly smaller than the diameter of the sidewall 14 of the bellows assembly so as not to contact the sidewall 14 in operation. The axial length of the stop 20 should be matched to that of the bellows assembly so that it is just contacting the end wall 18 in the first or unextended position thereby limiting the inward movement of the end wall 18.

A tubing assembly 22 is provided to allow the gas mixture in the plasma panel 12 to flow, or pass, into the pressure compensating device during operation. As best seen in FIG. 2, the plasma panel 12 includes a pair of substrates 24 and 26 which form front and rear sidewalls. The substrates 24 and 26 are spaced apart from each other and sealed around the perimeter thereof to form a closed chamber or envelope, 28. The tubing assembly 22 extends axially through the substrate 24 where it communicates with the chamber 28. The entire bellows assembly, including tubing assembly 22 and stop 20, are preferably fabricated from a non-contaminating material that is compatible with the thermal expansion characteristics of the substrates 24 and 26 from which the plasma panel is formed. Because the bellows assembly must withstand a high temperature during the manufacturing process, a material, such as stainless steel, which does not deteriorate at high temperature is well suited for this application.

The entire pressure compensating device is preferably enclosed in a shield or guard, such as a porous screen 34, to prevent inadvertent damage to the bellows assembly. However, it should be noted that the outward end of the screen 34 should be sufficiently spaced from the end wall 18 of the bellows assembly to allow for axial movement of the sidewall 14 during operation. In addition, the precise distance separating the screen 34 from the end wall 18 in the first or unexpanded state can be carefully calculated so that the screening provides a maximum limit or upper stop to the outward movement of the bellows thus preventing a rupture of the sidewall 14 during operation.

Still referring to FIG. 2 in addition to FIG. 1, as briefly mentioned herebefore, plasma panels are generally known and panels of various sizes have been used for many years as display devices. The panels are particularly well suited for use where a thin display is desirable. Another advantage of a plasma panel is that it can be addressed by relatively low voltage solid state circuitry. The substrate 26 which forms the front sidewall of the panel, and normally the substrate 24 which forms the rear sidewall, are transparent so that the viewer can observe the display therethrough. A large number of electrodes, such as row electrodes 34, 36, 38 and 40, and column electrode 42, are provided and are positioned on the substrate 24 and 26, respectively. The spacing between adjacent row and column electrodes is normally related to the horizontal and vertical resolution of the display. All of the electrodes are preferably fabricated from a conductive material, such as gold or aluminum, and an early step in the manufacturing process involves the depositing of the electrodes on each substrate by one of the numerous well-known processes, such as vacuum deposition, stencil screening, photo etching, or the like. Tin oxide or indium oxide can also be used for the fabrication of electrodes on the smaller plasma panel even though they have higher resistivity because the total resistance is still within acceptable limits; of course, the transparent or semi-transparent characteristic of the tin oxide or indium oxide is particularly desirable for use in a plasma panel. As is seen in FIG. 2, a later step in the manufacturing process would involve a dielectric layer 44 and 46 which are positioned on the substrates 24 and 26, respectively, thus coating each of the row and column electrodes. The material forming each dielectric layer is preferably selected so that its thermal expansion characteristic somewhat matches the thermal expansion characteristic of the substrate material. Each dielectric layer should be smooth, without cracks, holes, dirt, or other surface imperfections so that it will have a high, and relatively constant, breakdown voltage, i.e. on the order of 1,000 volts. In that electron flow occurs through the ionized gas in the chamber 28 during the operation of the panel, the dielectric material should also have good electron emissive capability, or alternatively, both the dielectric layer 44 and 46 may be covered with an overcoat designed to produce such electron emission. As would be expected, the dielectric material and overcoat, if any, should be relatively transparent in that the light generated between the substrate needs to pass out through the panel sidewall to the viewer. The two substrates 24 and 26 are held apart by one or more spacers (not shown) which are located at laterally spaced positions between the panel sidewalls.

During the manufacturing process each substrate is normally manufactured separately. In a final manufacturing step the spacers are then positioned between the two substrates and the panel is sealed around the outside edge to form a hermetically sealed chamber between the two substrates. The pressure compensating device would normally be attached by this time and sealed against the substrate 24 to maintain the closed integrity of the chamber. One or more purge tubes, such as purge tube 50 (FIG. 1), are normally provided for evacuating the chamber 28, and this evacuation process normally occurring at an elevated temperature to ensure that the maximum amount of air is removed from the chamber. The chamber is then filled with an ionizationable gas or gas mixture in a back filling process. A number of gases or gas mixtures, are known to be suitable as a gas discharge medium in a plasma panel, one such being neon with a minority of xenon or argon, helium, or other noble gases. A typical back fill pressure would be approximately two thirds atmosphere, or about 450 Torr. Then, during the tip-off process, the purge tubes are sealed thus closing the interior chamber and the panel is ready for operation.

Figure 3:
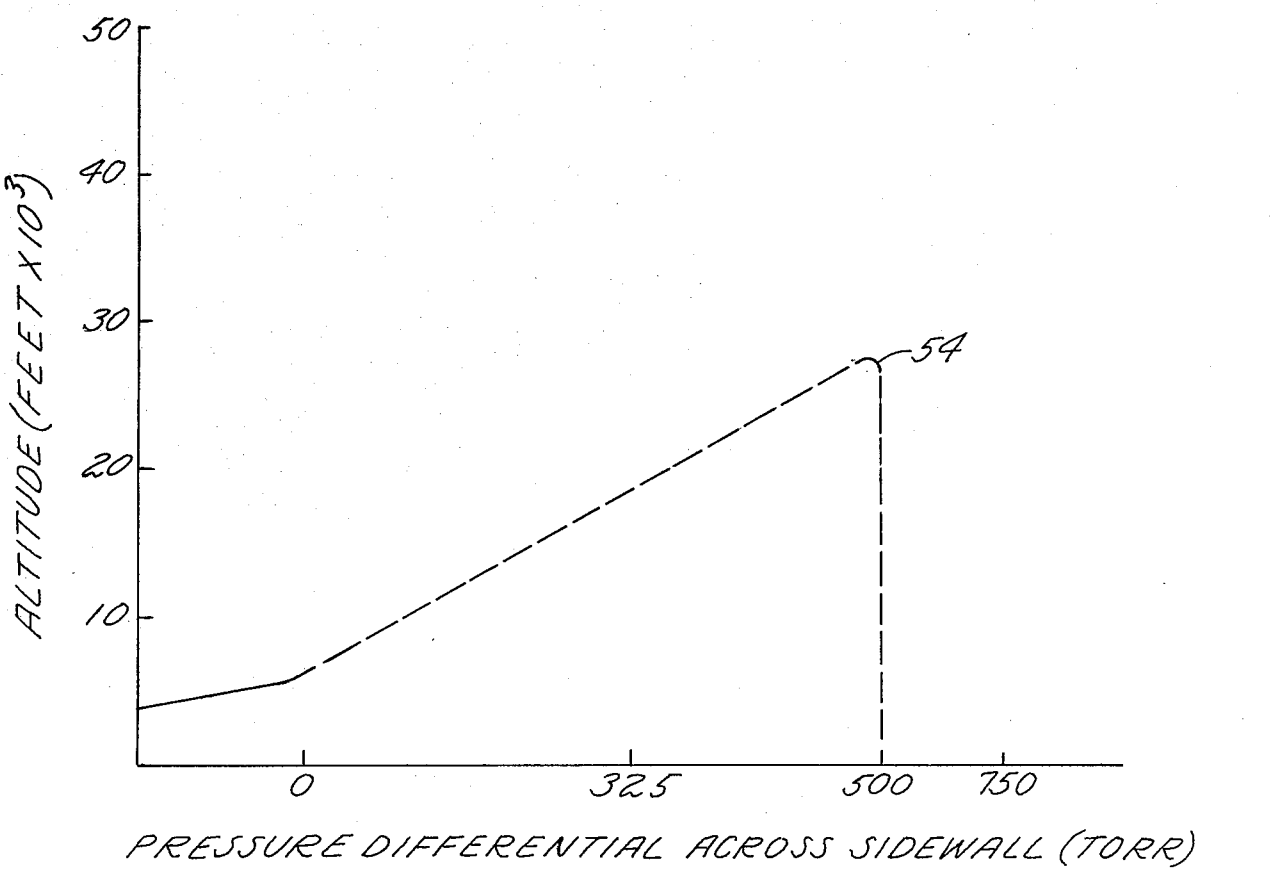
FIG. 3 is a graph depicting the operation of the pressure compensating device according to the present invention at various altitudes.

As mentioned briefly herebefore, a particular feature of the pressure compensating device according to the present invention is that it allows a plasma panel to be operated in an environment, such as the cockpit of an aircraft, which can be subject to a wide range of pressures and temperatures. Since the plasma panel contains a gas which is at a given pressure, approximately 450 Torr, the gas being required for operation, this gas asserts essentially a constant pressure per unit area on the inside wall of both the substrates 24 and 26. At sea level, and the lower elevations, the ambient atmospheric pressure, about 1 atmosphere, exceeds the pressure inside the chamber 28 creating a per unit force which exceeds or balances the force exerted by the gas in the chamber so that the composite force across both sidewalls is either inward or negative. However, as is best seen in FIG. 3, at an altitude above about 6,000 feet or so, the interior pressure of the gas within the sealed chamber 28 of a typical plasma panel begins to exceed the ambient air pressure causing a positive outward force to be exerted against the substrates 24 and 26. This positive pressure differential across the panel sidewall will continue to increase at higher and higher altitudes causing a bowing or outward flexing of the substrates 24 and 26. In turn, this positive pressure increases the separation between the substrates, particularly near the central portion of the panel sidewalls (area 52 of FIG. 1) causing an unwritten circle to appear at this central area. Normally, this central area 52 will become larger and larger until finally, at some point (point 54 of FIG. 3) a catastrophic failure of the sealed chamber, either around the sealed periphery or elsewhere occurs resulting in a total panel failure.

A particular feature of the pressure compensating device of the present invention is that it moves from its retracted position to an extended position in response to a positive pressure differential across the panel sidewall thereby ensuring that the panel seals will not be ruptured by an over pressure condition. As is seen in FIG. 2, initially the bellows assembly is designed so that the end wall 18 is resting against the end of the stop 20. As the panel 10 is exposed to altitudes higher than about 6,000 feet the pressure differential across the sidewall changes from a negative pressure (inwardly directed) to a positive pressure (outward directed) causing a positive force against the substrates 24 and 26 which is reflected in a separating force being exerted at the seals around the perimeter of the panel. At this time the bellows assembly would begin to expand moving axially as the positive pressure increases until it reaches its end position (shown in phantom in FIG. 2) the maximum design altitude. Accordingly, as is seen at line 50 of FIG. 3, the positive pressure differential across the sidewall only increases by a smaller amount as the panel is used at a higher and higher altitude. Of course, as is well known it should be understood that an increase in environmental and/or operating temperature typically results in a corresponding increase in the gas pressure in the plasma panel. It also should be understood that while the bellows is moving from its rest to its fully extended position that the absolute pressure in the panel is necessarily being decreased and it may be necessary to increase the magnitude of the sustainer voltage waveform to compensate for this absolute pressure decrease.

Another advantage of the pressure compensating device according to the present invention is that it allows a lighter than normal plasma to be used in an aircraft, or the like. This occurs because the substrates can be thinner than otherwise necessary to withstand positive pressure differentials across the panel sidewalls.

Although the invention has been shown and described with respect to a preferred embodiment thereof, it should be understood by those skilled in the art that numerous other changes and omissions in the form and detail thereof may be made without departing from the spirit and scope of the invention.

I claim:

1. A pressure compensating device for use with a plasma display panel, said panel including an ionizable gas disposed in a sealed envelope between a pair of sidewalls at least one of which is transparent, comprising:

a pressure responsive means secured to one of said sidewalls and having a first position in an unexpanded state, and a second position in an expanded state, means providing a passageway from said sealed envelope within said plasma panel to said pressure responsive means thereby allowing said gas to flow therebetween, and whereby said pressure responsive means moves from said first position to said second position in response to a positive pressure differential across said sidewalls of said panel thereby providing a space into which a portion of said ionizable gas flows thus maintaining said positive pressure differential within predetermined limits.

2. A pressure compensating device according to claim 1, wherein said sidewalls of said plasma panel comprises substrates and wherein said pressure responsive means is a bellows having a passageway extending from the interior of said bellows to the sealed envelope within the panel allowing a free flow of gas therebetween.

3. A pressure compensating device according to claim 2, wherein said bellows is cylindrically shaped with an accordion-like sidewall which is contracted in said first position, and wherein said sidewall expands actually to said second position increasing the size of said chamber therein.

4. A pressure compensating device according to claim 2, wherein said bellows includes an end wall which is sealed against the perimeter of said accordion-like sidewall, and wherein a stop is located within the interior of said bellows and engages said end wall in said first position.

5. A pressure compensating device according to claim 4, wherein the said stop includes a sealed vacuum chamber.

6. A pressure compensating device according to claim 5, wherein said bellows and said stop are an integrated unit which is fixedly attached to one of said pair of sidewalls during the manufacturing process.

7. A pressure compensating device according to claim 4, further including a screen mounted on said substrate enclosing said bellows and wherein said screen is spaced apart a predetermined distance from said end wall of said bellows thus acting as a stop limiting the outward axial movement of said bellows.

8. A pressure compensating device according to claim 1, wherein said bellows is fabricated from a selected material so as to not contaminate the ionizationable gas disposed in said sealed envelope.

9. A pressure compensating device according to claim 1, further including a protective device, such as a screen, enclosing said bellows thereby protecting said bellows from mechanical damage.

* * * * *